United States Patent [19]

Weiss et al.

[11] 4,141,755

[45] Feb. 27, 1979

[54] MASONRY CONSTRUCTION MEMBER IMPREGNATED WITH A COPOLYMER OF HYDROXY ALKYL ACRYLATE OR METHACRYLATE WITH LONG CHAIN ALKYL ACRYLATE OR METHACRYLATE

[75] Inventors: Jonas Weiss, Plainfield; Richard F. Stockel, Bridgewater Township, Somerset County, both of N.J.

[73] Assignee: National Patent Development Corporation, New York, N.Y.

[21] Appl. No.: 454,863

[22] Filed: Mar. 26, 1974

[51] Int. Cl.[2] ..... B08B 7/00

[52] U.S. Cl. ..... 134/42; 52/517; 427/352; 428/334; 428/335; 428/336; 428/522

[58] Field of Search ..... 117/123 C, 123 D, 161 UC, 117/54; 260/86.1 E; 428/500, 522, 538, 336, 334, 335; 427/352; 52/517; 134/42

[56] References Cited

U.S. PATENT DOCUMENTS

| | | | |
|---|---|---|---|
| 2,827,397 | 3/1958 | Affleck | 260/72 |
| 3,200,007 | 8/1965 | Flowers | 117/240 |
| 3,269,994 | 8/1966 | Horn et al. | 117/122 |
| 3,310,421 | 3/1967 | Flowers | 117/161 |
| 3,376,155 | 4/1968 | O'Donnell | 117/54 |
| 3,379,549 | 4/1968 | Playfair | 117/2 |
| 3,515,579 | 6/1970 | Shepherd et al. | 117/161 |
| 3,575,123 | 4/1971 | Shepherd et al. | 117/123 |
| 3,632,416 | 1/1972 | Shepherd et al. | 117/161 |

*Primary Examiner*—Michael F. Esposito
*Assistant Examiner*—Sadie L. Childs
*Attorney, Agent, or Firm*—Cushman, Darby & Cushman

[57] ABSTRACT

Water insoluble, hydrophilic copolymers of 50 to 98% of hydroxyalkyl acrylate or methacrylate wherein the alkyl group has 2 to 3 carbon atoms with 2 to 50% stearyl acrylate or methacrylate are prepared. They are particularly effective for sealing and coating building materials.

19 Claims, 4 Drawing Figures

MASONRY CONSTRUCTION MEMBER IMPREGNATED WITH A COPOLYMER OF HYDROXY ALKYL ACRYLATE OR METHACRYLATE WITH LONG CHAIN ALKYL ACRYLATE OR METHACRYLATE

BACKGROUND OF THE INVENTION

Building materials, e.g., concrete, brick, marble, are often porous, difficult to clean and subject to practically permanent defacement with graffiti Painted surfaces are likewise difficult to cleanse of graffiti and dirt. Such surfaces can be of a wide variety including plaster, masonry, concrete, metal, the various types of woods, etc., coated with typical commercial paints including the water-based types and the oil-based types such as water-based latices, water-based enamels, the alkyds, the acrylics, the masonry paints, and others. Polymers which can seal or coat such painted or unpainted surfaces are needed to preserve their appearance and integrity and to allow the relatively easy removal of graffiti and dirt. The object of this invention is to describe hydrophilic polymeric systems which can be applied easily to such surfaces without changing their appearance, which will maintain good adhesion to concrete, masonry and paint even when wet, and which can give the above effects.

It has previously been proposed to coat building materials with hydroxyethyl acrylate monomer and polymerize the same in place: see, for example U.S. Pat. No. 2,827,397 to Affleck. It has also been proposed to preform a homopolymer of a hydroxy lower alkyl acrylate or methacrylate or a copolymer thereof with certain copolymerizable monomers including lower alkyl acrylates and methacrylates, e.g., up to hexyl acrylate: see Belgium Pat. No. 780,838 and German Offenlegungsschrift No. P 2211999.9.

Among the problems with the products produced in accordance with the Affleck procedure is lack of extended durability to weathering and to graffiti attacks due to insufficient polymer cure. The procedure in the Belgium patent and the corresponding German Offenlegungsschrift is an improvement over that of Affleck. However, there is a problem in obtaining adequate adhesion to the building material in some cases.

SUMMARY OF THE INVENTION

It has now been found that copolymers of 98 to 50% of hydroxy lower alkyl acrylates or methacrylates wherein the alkyl group has 2–3 carbon atoms with 2 to 50 weight % of stearyl methacrylate, or less preferably stearyl acrylate, are particularly effective for coating painted and unpainted surfaces, and in particular, unpainted masonry surfaces.

A preferred composition is a copolymer of 90% hydroxyethyl methacrylate (HEMA) and 10% stearyl methacrylate, cured in situ by the addition just before application of ammonium dichromate. The advantage provided by the introduction of stearyl methacrylate is in better adhesion when wet, especially to limestone, to marble, to glazed ceramic tile and to glazed brick. Also, dirt removal is somewhat easier from surfces treated with the stearyl methacrylate copolymer.

The copolymers of the present invention are useful in coating painted or unpainted masonry, building pavement and painted surfaces. By the term masonry there is intended to be included the conventional types of bound aggregates, e.g., clay or other bricks, cinder blocks, slag blocks, concrete blocks, blocks made from other aggregates, concrete, cement or stone walls, glazed bricks, glazed ceramic tile, marble, limestone, buildings of masonry construction, masonry curbs, e.g., of contrete or cement, blocks made from small stones, stucco, cement blocks or masonry walls or ceilings. By concrete and cement pavements there are intended to be included: roads, airport runways, tennis courts, sidewalks, stairs, floors made of concrete or cement.

By the term building there is intended to be included warehouses, houses, apartments, office buildings, parking garages, barns, stores and the like. These buildings generally have at least their major portion above the ground and are exposed to the atmosphere which includes the elements of air, rain, heat, cold and light, and normally also snow. Normally such buildings from time to time are subjected to subfreezing temperatures, e.g., below 0° C.(32° F). (As is also true of pavements). As will be appreciated, a minor portion of the structure can be in the ground below grade as basements, etc.

The buildings can have their exterior walls of poured concrete, stone, brick, precase concrete, e.g., as a curtain wall, granite, marble or limestone. The invention is useful with tall buildings, e.g., office buildings and apartments 5, 10 or 15 or more floors in height.

The coating of the copolymer is normally applied to the exposed surface of the masonary, building, or pavement, but in the case of individual units, e.g., brick or blocks, can be applied to all surfaces.

Small amounts of cross-linking monomers such as ethylene glycol diacrylate, ethylene glycol dimethacrylate, which may be present for example, as impurities in making the hydrophilic monomer, can be tolerated so long as they do not interfere with the application of the polymer from aqueous dispersion or organic solvent solution dispersion.

While the preferred lower hydroxyalkyl acrylate or methacrylate is hydroxyethyl methacrylate, there can also be used hydroxyethyl acrylate, hydroxypropyl acrylate and hydroxypropyl methacrylate.

A desirable range of hydroxyalkyl acrylate to stearyl methacrylate is 70 – 95% HEMA (or the like) and 30 – 5% stearyl methacrylate. The preferred range is 85 – 95% HEMA, 15–5% stearyl methacrylate. As indicated, less preferably stearyl acrylate can be used in place of stearyl methacrylate.

Unless otherwise indicated, all parts and percentages are by weight.

The moisture vapor permeable, film forming polymers of the invention may be applied to the masonry or pavement surface by brushing, spraying or roller coating from either an aqueous dispersion, or from an organic solvent vehicle. In general, better penetration of the coating into the surface is obtained if an organic solvent is employed.

Typical suitable solvents are ethanol, methyl cellosolve (monomethyl ether of ethylene glycol), ethyl cellosolve, isopropanol, and aqueous mixtures of the aforementioned. Diluents can be included, e.g., xylene, toluene and benzene.

In general, the coatings of this invention are applied to provide a dry film thickness of from 0.1 to 3 mils. Due to economic considerations and to avoid changing surface appearance, it is preferred to apply the coating in thickness of less than 1 mil.

It has been found to be critical to employ stearyl methacrylate since lower alkyl methacrylates such as lauryl methacrylate give inferior results. In fact, the alkyl group in the methacrylate should in no case be less than 16 carbon atoms, e.g., palmityl methacrylate.

Any conventional catalyst can be employed for polymerizing the monomers. Thus, there can be used, for example, free radical catalysts in the amount of 0.05 to 1% of the polymerizable monomers. Typical catalysts include t-butyl peroctoate, benzoyl peroxide, isopropyl percarbonate, 2,4-dichlorobenzoyl peroxide, methyl ethyl ketone peroxide, cumene hydroperoxide, dicumyl peroxide, 1,3-bis(t-butylperoxyisopropyl)benzene, azobis-isobutyronitrile.

The copolymers of the invention include, for example, copolymers of:

95% HEMA; 5% stearyl methacrylate
90% HEMA; 10% stearyl methacrylate
80% HEMA; 20% stearyl methacrylate
70% HEMA; 30% stearyl methacrylate
60% HEMA; 40% stearyl methacrylate
50% HEMA; 50% stearyl methacrylate The soluble polymers are cross-linked and insolubilized after application to the cementitious or other masonry surface or painted surface with chemical cross-linking agents. The cross-linking agents are normally added prior to application to the masonry or other surface.

Thus, there can be used 0.1 to 5%, preferably 0.2 to 1% based on the copolymer of curing agents such as sodium, potassium or ammonium dichromate.

There can be used polyvalent metal alkoxides or other metal organic compounds as curing agents. Thus, there can be used for example 0.2 to 20 parts of such metal organic compounds per 100 parts of hydrophilic polymer.

Thus, there can be used alkyl titanates such as tetraisopropyl titanate, tetraethyl titanate, tetrabutyl titanate, tetrakis (2-ethyl hexyl) titanate, tetramethyl titanate or less reactive titanates, e.g., titanium acetyl acetonate as well as the corresponding zirconates, e.g., tetraisopropyl zirconate and tetrabutyl zirconate. There can also be used magnesium and aluminum or sodium aluminum alkoxides such as bis(methoxy-epoxy) magnesium [$Mg(OCH_2CH_2OCH_3)_2$]; $NaAl(OCH_2CH_2OCH_3)_4$; $NaAl(OCH_2CH_2OC_2H_5)_4$; $Na_3Al(OCH_2CH_2OCH_3)_6$; $Na_3Al(OCH_2CH_2OC_2H_5)_6$; $Na_3Al(OCH_2CH_2OCH_2CH_2OCH_3)_6$; $Al(OCH_2CH_2OCH_3)_3$.

Typical examples of suitable proportions of such metal organic compounds as curing agents in phr (parts per 100 parts of polymer) are:

ALKALYST ™ 114 (from Realco Chemical) $NaAl(OCH_2CH_2OCH_3)_4$ — 2.5 phr ALKALYST ™ 316D (Realco Chemical) $Na_3Al(OCH_2CH_2OCH_2OCH_3)_6$ — 2.5 phr
Al $(OCH_2CH_2—OCH_3)_3$— 9 phr
Mg $(OCH_2CH_2OCH_3)_2$ — 10 phr
Tetraisopropyl zirconate — 10 phr
Tetraisopropyl titanate — 3 to 10 phr
Tetrabutyl titanate — 10 phr
Tetrakis (2-ethylhexyl) titanate — 3 phr Less reactive compounds, such as titanium acetyl acetonate, can be used to cure the polymer but normally require heat, e.g., 135° C. for 30 minutes.

An additional advantage for the use of the alkoxides is the increase in viscosity they impart to hydroxylic polymer solutions. This is useful in coating porous substrates, such as brick or cement. For example, a 6% by weight solution of poly(hydroxyethyl methacrylate) [polyHEMA] at an intrinsic viscosity of 0.5, in methyl Cellosolve solvent, has a Brookfield viscosity of 13 cps model LVT. no. 1 spindle, 60 rpm, 25° C.). With 10 phr of tetraisopropyl titanate, the viscosity is 18 cps, and at 20 phr of the titanate the viscosity is 20 cps.

Amines accelerate the curing action of the metal alkoxides. For example, 2 phr of triethylenediamine reduces the curing time for polyHEMA with 10 phr tetraisopropyl titanate from 72 hours to 24 hours at room temperature. The amine catalysts, however, can be omitted.

For spray applications, a viscosity of about 22 cps. for the polymer solution with curing agent is desirable. To obtain this value the polymer solution, e.g., in methyl Cellosolve, is diluted with xylene and methyl Cellosolve (ethylene glycol monomethyl ether) to about 8% solids. The amount of xylene to be added (for improved solubility) is 5 weight % of the original polymer solution; methyl Cellosolve makes up the remainder of the diluting solvent.

A preferred curing agent for the 8% polymer solution is a 20% aqueous ammonium dichromate solution. The water vapor transmission rates (WVTR) expressed in gram-mil/sq. meter/day/atmosphere should be at least about 1000, desirably about 1200 and preferably at least 1500. The WVTR for a 90% HEMA - 10% SMA copolymer of the invention is at least about 1500 and for a 50% HEMA-50% SMA copolymer is at least about 1000. The final solution is applied within 8 hours, by means of an airless spray gun, a paint brush, or by other conventional methods.

As indicated above, polymerization can be carried out using conventional procedures. Unless otherwise indicated, all parts and percentages are by weight.

For example, the monomers are copolymerized in ethylene glycol monomethyl ether under commonly followed procedures. Illustratively, 18 parts (by weight) of HEMA, two parts of stearyl methacrylate and 80 parts of solvent are charged into a reaction kettle and flushed with nitrogen. The solution is heated to 80° C., 0.075 parts of azobis(isobutyronitrile) initiator is added, and the solution is stirred and heated until about 90% conversion to polymer is accomplished. The solution is then diluted with the same solvent to 8% solids. The polymer is cross-linked in situ by adding the cross-linking agent(s) just prior to application.

After application to the masonry substrate, the polymer solution dries to give film which cures in about 24 hours. The cured polymer exhibits good adhesion to limestone, concrete, brick and other masonry materials. It is insoluble in water and common organic solvents. To the extent that the film is intact over holes in the masonry, it prevents liquid water from permeating. However, water vapor permeability is very high compared to almost all other polymers.

Important graffiti protection is provided by keeping the graffiti (e.g., spray paint, marker pens) on the surface of the building material and out of the small pores. Then the graffiti can easily be washed off with a solvent that does not affect the polymer film. Thus, the cycle of graffiti removal can be repeated, unlike the case with several other materials, which are only useful once.

Among the advantages of the stearyl methacrylate-containing copolymers over HEMA polymers described in De Long Belgian Pat. No. 780,838 or German Offenlegungsschrift P 2211999.9, is increased flexibility, which can help keep the polymer intact on the building surface. Another advantage is increased cleanability. The conventional essential hompolymer of HEMA has been observed to cause the surface to get dirty faster under some conditions than an untreated surface. However, the copolymers of the present invention improve the cleanabilty of building surfaces significantly.

BRIEF DESCRIPTION OF THE DRAWINGS

The invention will be understood best in connection with the drawing wherein.

Figure 1:
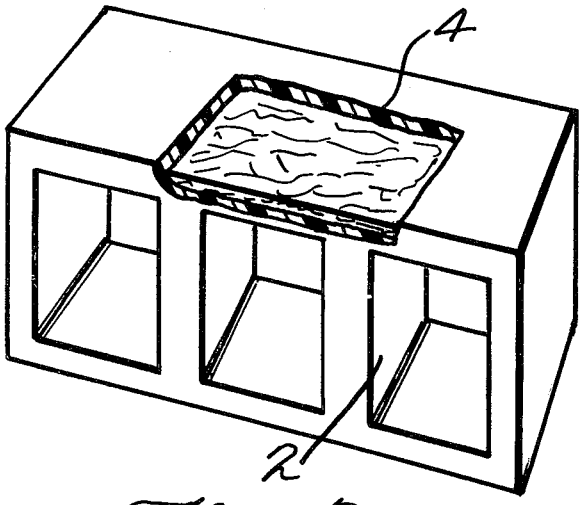
FIG. 1 is a perspective view partially broken away in section of a masonry block coated according to the invention.

Referring more specifically to FIG. 1 of the drawings, a conventional lightweight concrete block 2 has applied thereto a surface coating 4, of a hydroxyethyl methacrylate (HEMA) stearyl methacrylate copolymer (80:20). The thickness of the coating is greatly exaggerated for purpose of clarity.

Figure 2:
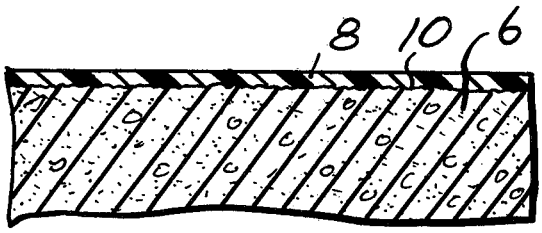
FIG. 2 is a vertical elevation, broken away and in section, of a concrete pavement treated in accordance with the invention.

In FIG. 2 a concrete road 6, has a coating 8, of a copolymer of hydroxyethyl methacrylate and stearyl methacrylate (SMA), (85:15) on the surface of the road. The thickness of the coating is greatly exaggerated.

Figure 3:
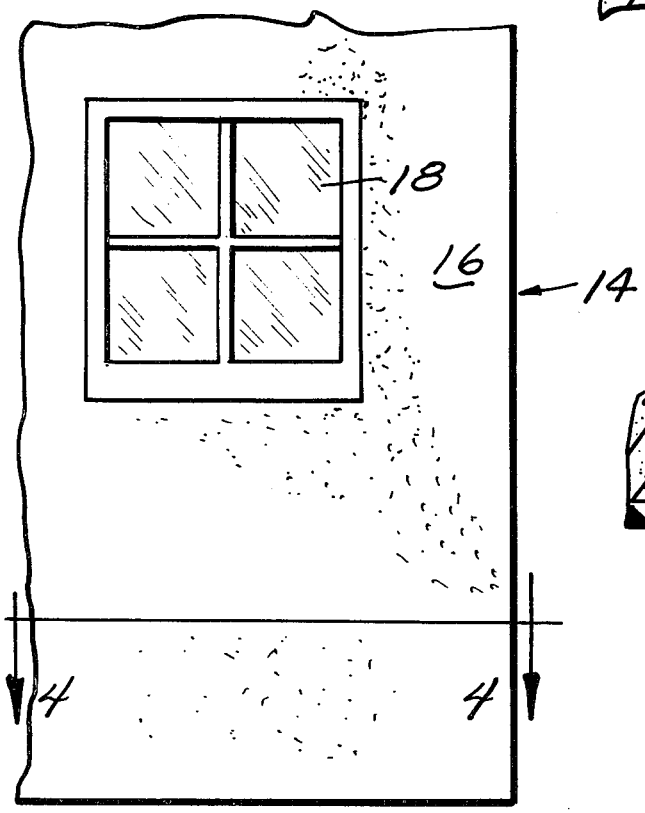
FIG. 3 is a partial plan view of a building treated in accordance with the invention.
Figure 4:
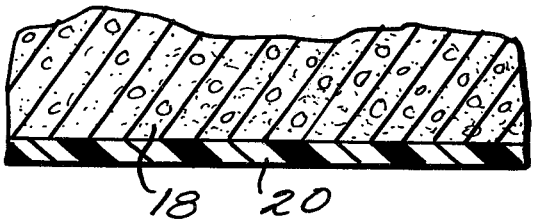
FIG. 4 is a sectional view along the lines 4—4 of FIG. 3.

Referring to FIGS. 3 and 4, there is provided an apartment house 14 having an exterior precast concrete wall 16 having a plurality of windows 18 therein. A thin (about 1 mil) coating 20 of HEMA-SMA copolymer (70:30) is applied to the exterior surface of the concrete wall. If desired, a coating of the same HEMA-SMA copolymer can be applied to the interior and/or exterior surface on the windows. When applied to the windows the polymer acts as a non-fogging coating.

DETAILED DESCRIPTION

To prevent attack of the concrete pavement, building or masonry surface by bacteria or fungi or other microorganisms, there can be incorporated with the polymer to be applied as a coating, a bactericide or fungicide, e.g, in an amount of 0.1 to 35% of the polymer. The bactericide or fungicide is leachably entrapped in the polymer coating, i.e., it is slowly releasable in the presence of water. Thus, there can be employed any of the bactericides or other pecticides set forth in the above identified Belgian Pat. No. 780,838 and German Offenlegungsschrift P No. 2211999.4.

EXAMPLE 1

HEMA (360 parts), stearyl methacrylate (40 parts) and methyl Cellosolve (1600 parts) are added to a reaction kettle and flushed with dry nitrogen. The temperature is raised to 70° C. and 1.5 parts VAZO (azo-bis-(isobutyronitrile), is added. The reaction mixture is continuously stirred, flushed with nitrogen and heated at 81± 2° C. for 6 hours after the catalyst addition, at which time the solids content should be close to 19%. On completing the reaction the Brookfield viscosity (model LVT, spindle No. 1, 60 RPM, 25° C.) should be approximately 86 cps. at this solids level.

To 100 parts of the copolymer solution prepared in Example 1 (20 parts copolymer 80 parts solvent) there were added 0.5 parts of a 20 weight % solution of ammonium dichromate in water per hundred parts of resin (555 parts of polymer solution to 1 part of curing agent) and the composition applied to concrete and allowed to cure.

In a series of experiments there were applied to concrete substrate a series of polymers as follows:

HEMA polymer (100%)
HEMA-stearyl methacrylate copolymer; (90:10)
HEMA-stearyl methacrylate copolymer; (80:20)
HEMA-stearyl methacrylate copolymer (70:30)
HEMA-stearyl methacrylate copolymer; (50:50)
HEMA-methyl methacrylate copolymer; (90:10)
HEMA-methyl methacrylate copolymer; (80:20)
HEMA-methyl methacrylate copolymer; (70:30)
HEMA-methyl methacrylate copolymer; (50:50)

The HEMA-stearyl methacrylate copolymer (90:10) was generally best in weatherability and dirt resistance, on the concrete substrate. It was somewhat inferior only to 100% polyHEMA in graffiti resistance. Subsequent experiments of the same type showed that neither 60:40 copolymers with (a) 2-ethylhexyl methacrylate, nor (b) lauryl methacrylate had the solvent resistance needed for repeated graffiti removal cycling.

EXAMPLE 2:

180 grams of HEMA, 20 grams of SMA and 0.75 grams of VAZO were added over 2½ hours to 800 grams of methyl Cellosolve at reflux in a nitrogen atmosphere. Reflux was continued for another 3½ hours. The final copolymer had 19.7% solids.

The polymer was coated on a surface and the solvent removed to give a film having a thickness of 4 mils. The water vapor transmission of the film having a surface area of 3.88 square inches (25 $cm^2$) was measured and found to be 1.0247 grams for a 24 hour period.

EXAMPLE 3:

There were made up a series of HEMA-SMA copolymers in methyl Cellosolve utilizing the procedure employed in Example 2. These solutions were each diluted to 7% solids and were designated as:

(a) HEMA-SMA (90:10)
(b) HEMA-SMA (80:20)
(c) HEMA-SMA (70:30)

To 100 grams of each of (a), (b) and (c) there were added 5.6 grams of a 21.6% solution of TPT in methyl Cellosolve (hereinafter called Cat. B) and 1.4 grams of triethylene diamine as a 21.6% in methyl Cellosolve (hereinafter called Cat. C). The resulting solutions were applied to glass plates and tile and allowed to cure for 24 hours.

On the glass plates (a), (b) and (c) all showed good resistance to water, (a) had good resistance to methyl alcohol, (b) had fair resistance to methyl alcohol and (c) failed in resistance to methyl alcohol.

The wetting angle on all three of (a), (b) and (c) was better than on straight HEMA homopolymer.

Compositions (a) and (b) show good adhesion to marble when tested with water. The adhesion of (a) was better than (b). Composition (c) did not show as good resistance to water as compositions (a) and (b) when coated on marble.

EXAMPLE 4

There were added 320 grams of HEMA, 80 grams of SMA and 1.5 grams of VAZO to 1600 grams of methyl Cellosolve at reflux under a nitrogen atmosphere. The addition took 3 hours and refluxing was continued for another 2¾ hours. The product had 18.7% solids.

To 95 parts of the above solution there were added 5 parts of xylene the solution had a Brookfied viscosity of 16.0 cps. at 25° C. Upon addition to 100 grams of the final solution of 7.10 grams of Cat. B and 1.8 grams of Cat. C. the Brookfield viscosity was 20.8 cps. at 25° C.

EXAMPLE 5

There were applied to polished marble solutions (a), (b) and (c) of Example 3, at 6% solids in methyl cellosolve containing 5% of xylene, based on the total polymer solution and using 5 parts of Cat. B and 1 part of Cat. C to 100 parts of the polymer solution. All three final polymer solutions were cured for 24 hours and the marble was tested for dirt and graffiti removal. All three showed good graffiti removal with tap water upon repeated testing. The 90:10 HEMA-SMA composition was best in the repeated testing and the 80:20 HEMA-SMA next best. The 90:10 HEMA-SMA and 80:20 HEMA-SMA were also tested for graffiti removed from polished black marble using Red Devil 99 solvent followed by methanol and tap water. Both coated marbles still had a good appearance after the applications and removals of graffiti with the 90:10 being slightly superior.

EXAMPLE 6

Films of copolymers of (a) HEMA-lauryl methacrylate (60:40), (b) HEMA-2-ethyl hexyl methacrylate (60:40), and (c) HEMA-stearyl methacrylate (90:10) were prepared using 0.8 phr of ammonium dichromate as a curing agent. When Red Devil No. 99 liquid (a standard graffiti removal solvent) was applied to the cured films (a), (b) and (c), both filsm (a) and (b) softened and became tacky within one minute of exposure while (c) was unaffected.

EXAMPLE 7

200 grams of HEMA, 200 grams of SMA and 1.5 grams of VAZO were added under a nitrogen atmosphere to 1600 grams of methyl Cellosolve under reflux for 3½ hours and reflux continued for 3½ hours more. The composition had 18.0% solids and a Brookfield viscosity of 43.5 cps. at 25° C. It was diluted with 10% xylene to give a solution having a Brookfied viscosity of 18.3 cps. at 25° C. To 100 grams of the solution there were added 5.6 grams of Cat. B and 1.4 grams of Cat. C. The final composition had a Brookfield viscosity of 19.7 cps. at 25° C.

EXAMPLE 8

Solutions of 6% solids in methyl Cellosolve of (a) HEMA-SMA copolymer (90:10), (b) polyHEMA (100%) and (C) HEMAmethyl methacrylate copolymer (70:30). To 100 parts of (a) there were added 4.32 parts of Cat. B and 1.08 parts of Cat. C, to 100 parts of (b) there were added 4.8 parts of Cat. B and 1.2 parts of Cat. C, These products were cured on tile and glazed bricks with the following results:

| Composition | Resistance to $H_2O$ | Resistance to $CH_3OH$ | Adhesion | Resistance to $Na_2CO_3$ Solution |
|---|---|---|---|---|
| | | Glazed Bricks | | |
| a | Good | Good | Good | Good |
| b | Fair-Poor | Good | Fair | Poor |
| c | Good | Slimy on Rub Good | Good | Good |

-continued

| Composition | Resistance to $H_2O$ | Resistance to $CH_3OH$ | Adhesion | Resistance to $Na_2CO_3$ Solution |
|---|---|---|---|---|
| | | Ceramic Tiles | | |
| a | Good | Good | Good | Good |
| b | Poor | Good | Fair-Poor | Poor |
| c | Good | Slimy on Rub Fair | Fair | Good |

The use of dichromate curing agents gives superior results to the use of titanate curing agents in prolonged weathering tests.

In the following experiments the dichromate curing agent was the 20% aqueous ammonium dichromate solution and the titanium curing agent was the tetraisopropyl titanate (TPT) and triethylene diamine mixture set forth in Example 3 above.

Test specimens were prepared as follows:

Mortar discs were prepared, cured, coated with two coats of 90 HEMA/10 Stearyl methacrylate copolymer, one set containing dichromate and another set containing titanate curing agent. Concrete and limestone slabs are similarly coated two times with the HEMA-SMA copolymer containing the different cure agents, and satin-finish and polished marble specimens were coated once with the two different solutions. The specimens are all allowed to dry and cure under indoor fluorescent lighting for 24 hours. The three tests which show up the differences between coatings are:

1. Outdoor weathering test.

The satin-finished marble, polished marble, concrete and limestone samples were placed on a rack on a roof facing due south and at a 45° angle to the vertical. Specimens were observed at the end of every month of exposure. After three months, the titanate coating was found to be completely gone from the polished marble sample and peeling from the concrete samples in contrast to the dichromate-cured samples which were intact. After four months, the limestone samples also showed coating removal for the titanate cure, but were still good for the dichromate cure.

2. Wet-UV Cycling Test

Coated mortar discs were cycled daily as follows: 2 hours under tap water, 2 hours under G.E. Type RS sunlamps (15 inches from lamp, surface temperature 200° F, approximately 1 day outdoor exposure is equivalent to 1 hour under lamp), 1 hour to cool to room temperature, 2 hours under water, 15 hours under sunlamp and 2 hours to cool. Every 5 days of this cycling was followed by 65 hours (one weekend) of straight sunlamp exposure. The results showed coating removal after 13 and 17 cycles for both series of titanate-cure samples. However, both series of dichromate-cured coatings were still good after 77 and 73 cycles.

3. Wet-Dry Cycling Test

Coated mortar discs were cycled as follows: 2 hours under tap water, 5 hours to dry at room temperature, 2 hours under water and 15 hours to dry. Every 5 days of this cycling was followed by 2 days dry at room temperature. After 34 cycles, the discs were placed under sunlamps (as above) for 764 hours. All of the titanate-cured coatings failed via coating removal, whereas both series of dichromate-cured samples were intact after the tests.

What is claimed is:

1. A masonry construction member having at least the major portion thereof exposed to the atmosphere having at least the exterior surface thereof impregnated with a durable, weather resistant, moisture vapor permeable coating of a preformed water insoluble, hydrophilic copolymer of 50 to 98% of hydroxyalkyl acrylate or methacrylate wherein the alkyl group has 2 to 3 carbon atoms with 2 to 50% stearyl acrylate or methacrylate.

2. A masonry construction member according to claim 1 wherein the hydroxyalkyl group is the hydroxyethyl group.

3. A masonry construction member according to claim 2 containing 95 to 70% of the hydroxyethyl methacrylate in the copolymer.

4. A masonry construction member according to claim 3 containing 95 to 85% of the hydroxyethyl methacrylate in the copolymer.

5. A masonry construction member according to claim 1 containing 95 to 70% of the hydroxyalkyl acrylate or methacrylate in the copolymer.

6. A masonry construction member according to claim 1 wherein the polymer is cross-linked.

7. A masonry construction member according to claim 1 wherein the copolymer is a copolymer of hydroxyethyl methacrylate and stearyl methacrylate.

8. A masonry construction member according to claim 7 wherein said coating is 0.1 to 4 mils thick when in the dry condition.

9. A masonry construction member according to claim 7 wherein the masonry construction member is a building wall.

10. A masonry construction member according to claim 7 made of marble or limestone.

11. A masonry construction member according to claim 7 which contains cement.

12. A masonry construction member according to claim 7 comprising clay.

13. A method of removing graffiti from a masonry construction member comprising washing a coated construction member of claim 1 to which graffiti has been applied over said coating.

14. A masonry construction member according to claim 1 wherein the copolymer contains 90% hydroxyethyl methacrylate and 10% stearyl methacrylate.

15. A masonry construction member according to claim 6 wherein the cross-linking agent is a dichromate.

16. A masonry construction member according to claim 15 wherein the dichromate is sodium, potassium or ammonium dichromate.

17. A masonry construction member according to claim 16 wherein the copolymer contains 90% hydroxyethyl methacrylate and 10% stearyl methacrylate.

18. A masonry construction member according to claim 17 wherein the dichromate is ammonium dichromate.

19. A painted or unpainted surface having a durable, weather resistant, moisture vapor permeable coating of a preformed water insoluble, hydrophilic copolymer of 50 to 98% of hydroxyalkyl acrylate or methacrylate wherein the alkyl group has 2 to 3 carbon atoms with 2 to 50% stearyl acrylate or methacrylate.

* * * * *